US007640830B2

(12) United States Patent
Bonis

(10) Patent No.: US 7,640,830 B2
(45) Date of Patent: Jan. 5, 2010

(54) LOCKING ADJUSTMENT TURRET

(76) Inventor: James G. Bonis, 170 Kenwick Rd., Rochester, NY (US) 14623

( * ) Notice: Subject to any disclaimer, the term of this patent is extended or adjusted under 35 U.S.C. 154(b) by 0 days.

(21) Appl. No.: 11/840,987

(22) Filed: Aug. 19, 2007

(65) Prior Publication Data

US 2009/0044660 A1 Feb. 19, 2009

(51) Int. Cl.
*F41G 1/38* (2006.01)
*B23Q 16/04* (2006.01)

(52) U.S. Cl. ..... 74/813 L; 74/813 R; 74/527; 42/125; 42/126; 42/119

(58) Field of Classification Search ..... 74/813 L, 74/813 R, 527, 557, 553; 42/125, 126, 119, 42/278, 279, 280
See application file for complete search history.

(56) References Cited

U.S. PATENT DOCUMENTS

| | | | | |
|---|---|---|---|---|
| 2,716,352 | A * | 8/1955 | Wilson | 74/89.39 |
| 3,990,155 | A | 11/1976 | Akin, Jr. et al. | |
| 4,247,161 | A | 1/1981 | Unertl, Jr. | |
| 4,373,269 | A | 2/1983 | Doliber et al. | |
| 4,393,595 | A | 7/1983 | Gibson | |
| 4,806,007 | A | 2/1989 | Bindon | |
| 5,363,559 | A | 11/1994 | McCurty | |
| 5,513,440 | A | 5/1996 | Murg | |
| 5,615,487 | A | 4/1997 | Tomita | |
| 6,279,259 | B1 | 8/2001 | Otteman | |
| 6,442,854 | B1 | 9/2002 | Liu et al. | |
| 6,519,890 | B1 | 2/2003 | Otteman | |
| 6,643,970 | B2 * | 11/2003 | Huber | 42/122 |
| 6,691,447 | B1 | 2/2004 | Otteman | |
| 2003/0216229 | A1 * | 11/2003 | Bastyr | 482/115 |
| 2006/0278035 | A1 | 12/2006 | Casas | |

* cited by examiner

*Primary Examiner*—Richard W L Ridley
*Assistant Examiner*—Thomas Diaz
(74) *Attorney, Agent, or Firm*—Shlesinger & Fitzsimmons

(57) ABSTRACT

A locking adjustment turret for rifle scopes includes a stationary portion mounted on an outer tube of the scope, a rotating adjustment portion supported in the stationary portion and including an adjustment knob such that rotation of the knob results in axial motion of a shaft toward and away from an inner tube of the scope, and a locking mechanism on the rotating adjustment portion that locks the shaft in a desired position. The locking mechanism includes a pin that engages a detent mechanism in the rotating adjustment portion, preventing rotation of the rotating adjustment portion. The locking mechanism is operated with a lock knob that sits atop the adjustment knob and is accommodated by a recess in the top of the adjustment knob.

15 Claims, 3 Drawing Sheets

LOCKING ADJUSTMENT TURRET

CROSS-REFERENCE TO RELATED APPLICATIONS

None applicable.

BACKGROUND AND SUMMARY

Embodiments disclosed herein relate to adjustment turrets, such as those used for adjusting telescopic sights used with weapons. In particular, embodiments relate to the turrets used to adjust elevation and windage in telescopic sights and that preferably include locking mechanisms to fix the turret in a particular position.

Many arrangements exist for adjusting the windage and elevation of telescopic sights. U.S. Pat. No. 5,363,559 to McCarty discloses a tube adjustment and locking device in which two turrets adjust the position of the tube and a third arrangement locks the tube in place once a desired elevation and windage have been achieved. The locking device can include a bias, such as a spring bias, or can be employed with no bias. The locking mechanism is positioned opposite the elevation and windage adjustment arrangements in the outer tube of the scope. When a bias in included in the locking mechanism, the elevation and windage are adjust as is customary while the bias opposes, yet allows, motion of the tube. Once the desired elevation and windage are achieved, the locking mechanism is engaged to restrain the tube from further motion. The basic structure of the locking mechanism is similar to that of the elevation and windage adjustment turrets.

U.S. Pat. No. 6,643,970 to Huber discloses a rifle scope adjustment mechanism that includes a T-shaped adjustment bolt vertically aligned inside an adjustment body fixed in position on the turret of the rifle scope. The adjustment body includes a small threaded central bore to which the adjustment bolt is attached. The adjustment body also includes an upward cavity with splines formed on the inside surface. When assembled, the threaded upper section of the adjacent bolt extends above the top surface of the adjustment body. Disposed longitudinally and locked in position over the threaded upper section of the adjustment bolt and around the adjustment body is an index dial. Attached to the threaded upper section that extends above the index dial is a stop ring and a lock ring that are selectively locked together on the upper section of the adjustment bolt. A tab element is formed on the top surface of the index dial body which is engaged by a complimentary-shaped tongue member of the stop ring which locks the index dial body and stop plate together to prevent further downward rotation of the stop plate over the body.

Another example of such adjustment mechanisms is seen in U.S. Pat. No. 6,691,447 to Otteman. Otteman discloses a non-telescoping riflescope adjustment mechanism in which the adjustment knob does not move axially when turned. The knob is attached to a threaded member such that the threaded member can move a second member with corresponding threads axially when the first member is rotated with the knob. While this has the advantage of having the knob stay in one position axially relative to the scope, the mechanism does not include a locking arrangement to lock in a desired position.

Embodiments overcome disadvantages of the prior art by providing an adjustment turret with a relatively simple, easy to manufacture, and easy to operate locking mechanism that does not require any tools to operate. When a desired position has been achieved with the turret, the user simply turns the knob of the locking mechanism to lock the turret in position.

BRIEF DESCRIPTION OF THE DRAWINGS

Embodiments are described with reference to the accompanying Figures in which.

DESCRIPTION

Figure 1:
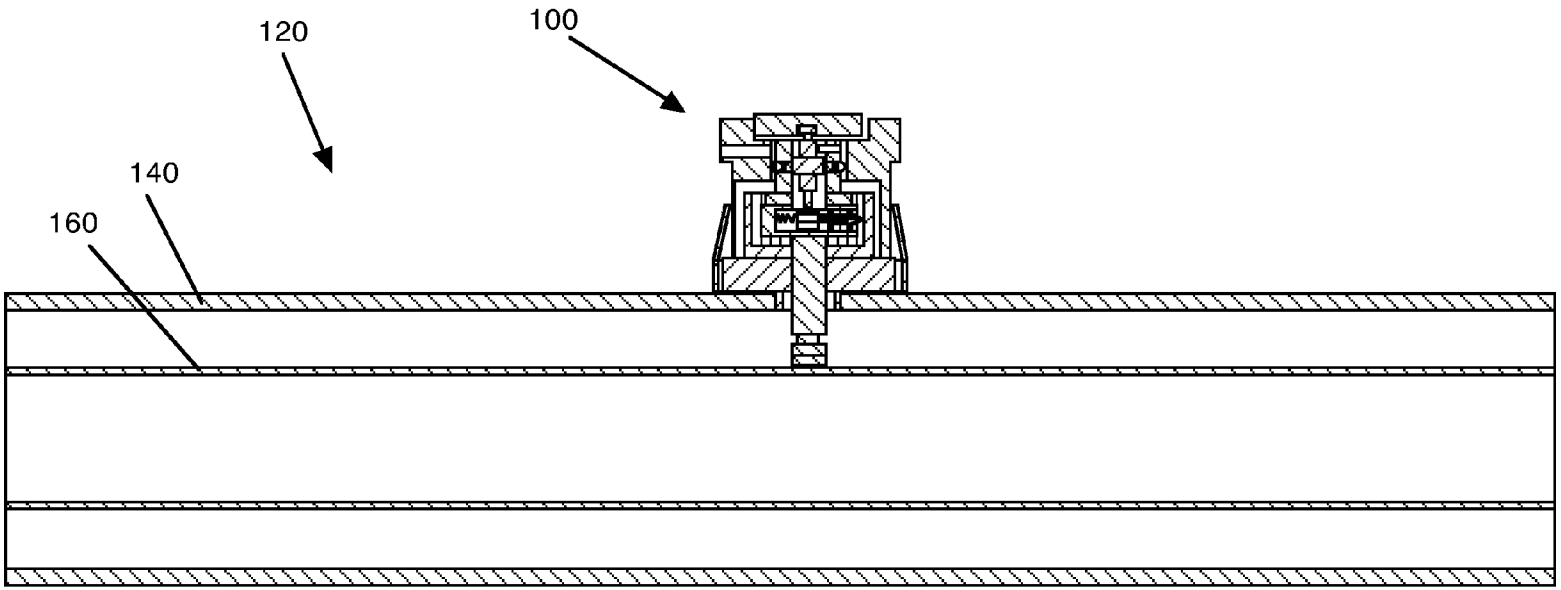
FIG. 1 shows a schematic representation of an optical gun sight in cross section and bearing a locking adjustment turret according to embodiments.

As seen in FIG. 1, an adjustment turret 100 according to embodiments can be mounted on a telescopic sight 120 including an outer tube 140 and an inner tube 160. The turret 100 bears on the inner tube 160 and moves the inner tube 160 in accordance with user manipulation of the turret 100 as will be described. Typically, two similar adjustment turrets will be deployed on the outer tube with their rotational axes orthogonal to one another. A spring bias is also typically used to force the inner tube against the adjustment members of the locking turrets, enabling adjustment of the inner tube position in a plane at the location of the turret rotational axes.

Figure 2:
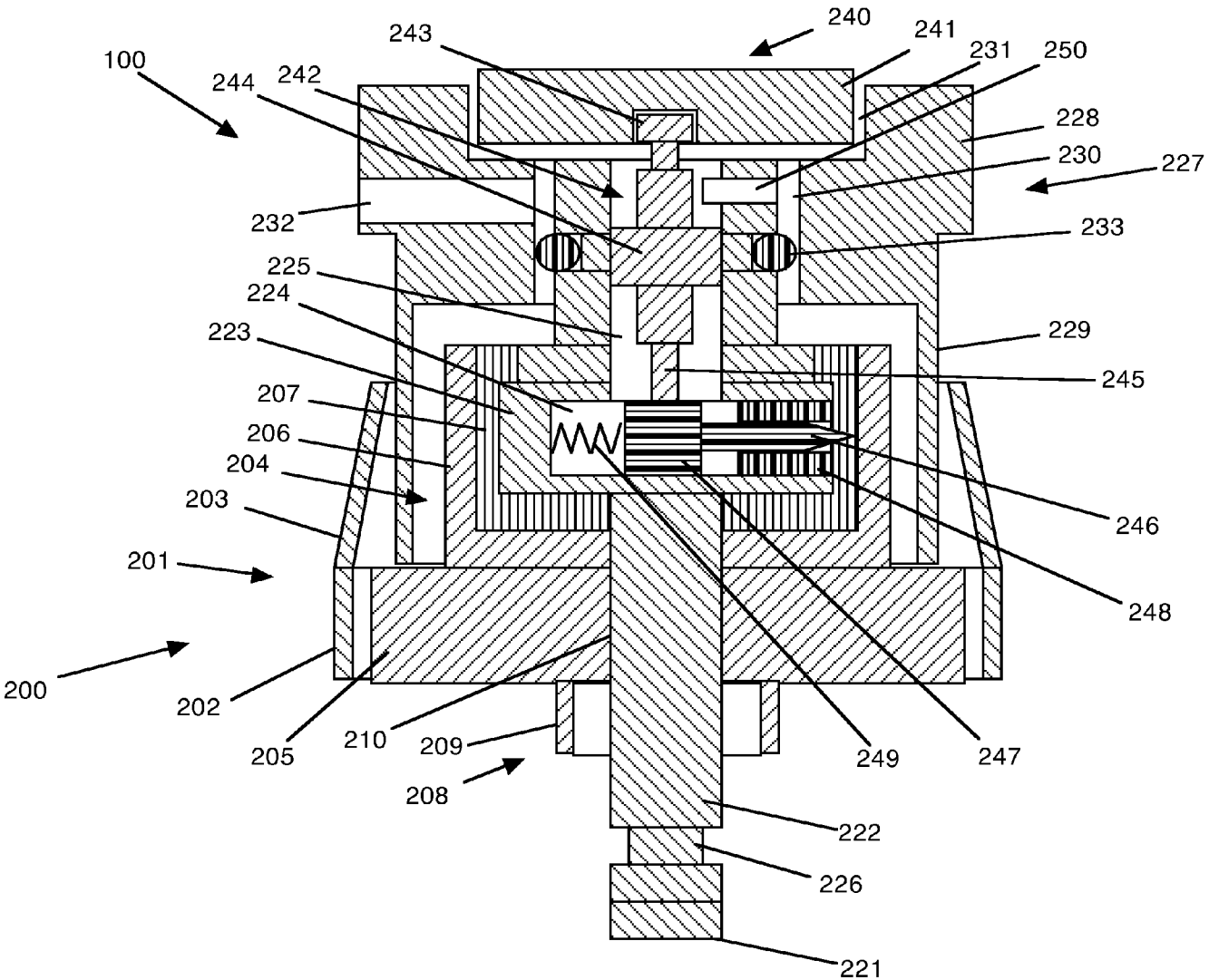
FIG. 2 is an enlarged schematic view of the locking adjustment turret of embodiments as seen in FIG. 1.
Figure 3:
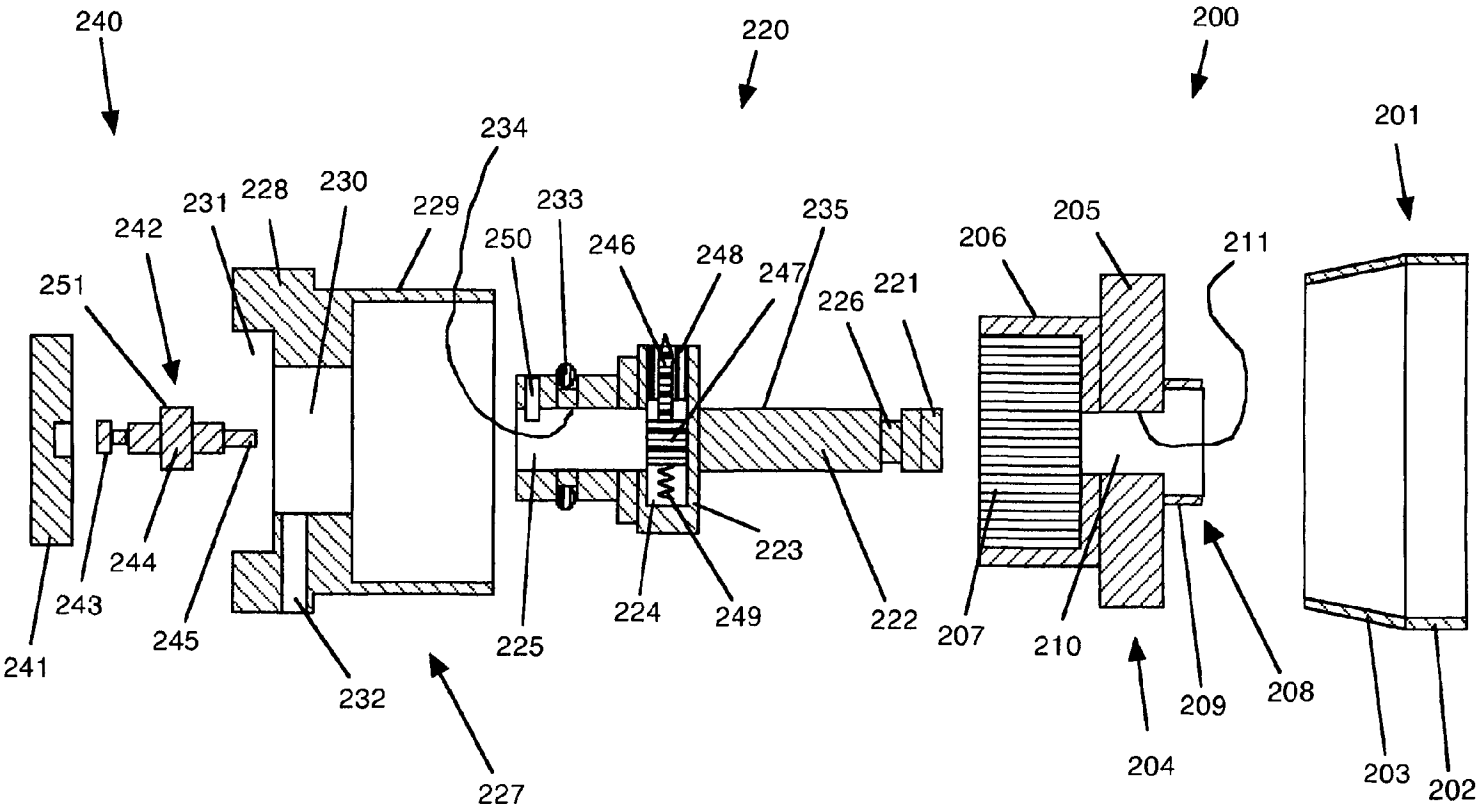
FIG. 3 is an exploded schematic view of the locking adjustment turret of embodiments as seen in FIGS. 1 and 2.

As seen in FIGS. 2 and 3, the turret 100 of embodiments includes a stationary portion 200 mounted on the outer tube 120, such as with threads as will be described, and supporting a rotating adjustment portion 220 that bears against the inner tube 140. The rotating adjustment portion 220 carries a locking mechanism 240 of embodiments. The stationary portion 200 includes an outer barrel 201 that in embodiments has a substantially cylindrical portion 202 and a substantially frustroconical portion 203. The stationary portion also includes an inner body 204, the outer barrel 201 surrounding most of the inner body 204 when the turret 100 is mounted on the outer tube 140. The inner body 204 includes a mid portion 205, an inner barrel portion 206. The inner surface of the inner barrel portion 206 bears longitudinal grooves 207 that are part of a detent system of the adjustment turret as will be explained below. The inner body 204 has a collar portion 208 that, when the turret 100 is mounted on the scope 120, projects into the outer tube 140. Preferably, the outer surface of the collar 208 bears threads 209 that retain the turret 200 on the outer tube 140 of the scope 120. The inner barrel portion 206 is open toward a top of the turret 100 and has an outer diameter slightly less than that of the inner diameter of the substantially frustroconical portion 203 of the outer barrel 201. The mid portion 205 includes a bore 210 through which the rotating adjustment portion 220 extends and preferably includes threads 211 on the inner surface of the bore 210 that interact with threads 234 on the rotating adjustment portion 220 to move the rotating adjustment portion 220 in and out of the outer tube 140. The mid portion 205 of the inner body 204 engages the inner surface of the bottom portion 202 of the outer barrel 201.

The rotating adjustment portion 220 of the turret 100 includes an engagement end 221 at the end of a shaft 222 attached to a main body 223. The main body 223 includes a partially diametral bore 224 in which parts of the detent mechanism are housed as will be explained below. The bore 224 is partially diametral in that it extends from the outer surface of the main body 223 transverse to a rotational axis thereof and through the rotational axis, but does not extend to the opposite surface of the main body 223. The main body also includes a longitudinal bore 225 extending from a top of the main body 223 and connecting to the bore 224. The shaft 222 preferably includes a reduced diameter portion 226 about which a retaining device can be mounted. The main body 223 extends into a knob 227 that sits about the main body 223 and the shaft 222. The knob 227 preferably includes an adjustment portion 228 and a barrel portion 229. A bore 230 extends from a circular recess 231 of the adjustment portion 228 into an interior of the barrel portion 229. The bore 230 accepts the upper portion of the main body 223, and the knob 227 is secured to the upper portion of the main body 223 via a retaining device 232, such as a set screw or the like, and an interference fit with an elastomeric body 233, such as an o-ring or a gasket. Preferably, the knob 227, main body 223, and shaft 222 rotate together when the adjustment portion 228 of the knob 227 is rotated.

The recess 231 of the knob 227 preferably accommodates a lock knob 241 of the locking mechanism 240. The lock knob 241 is attached to a lock body 242 via a lock knob mount 243 such that the lock knob 241 and lock body 242 rotate together. Alternatively, the lock knob 241 and lock body 242 could be formed as a single piece, though this is not preferred do to manufacturing costs when the parts are made from metallic materials. The lock body 242 includes a main lock body portion 244 that supports the lock knob mount 243 and a lock pin 245 and is housed in the bore 225 of the rotating adjustment portion 225. A detent pin 246 extends from a larger-diameter detent body 247 slidingly mounted in the bore 224 of the rotating adjustment portion 220. The detent pin 246 preferably extends through a collar 248 that prevents the detent body 247 from exiting the bore 224 while allowing sliding movement of the detent pin 246. A spring or the like 249 is mounted between an end wall of the bore 224 and the detent body 247 to bias the detent body 247 toward the collar 248. The entire locking mechanism 240 rotates with the rotating adjustment mechanism 220 when the knob 227 is manipulated. The entire locking mechanism 240 also moves axially with the rotating adjustment mechanism 220 when the knob 227 is manipulated.

The lock body 242 sits in the bore 225 of the rotating adjustment portion 220 with the pin in proximity to the detent body 247. The main lock body portion 244 is prevented from exiting the bore by a retaining device 250, such as a set screw or the like. Additionally, the main lock body portion 247 preferably carries threads 251 on its outer surface that interact with corresponding threads 234 in the bore 225. Thus, rotating the lock body 242 by manipulation of the lock knob 241 results in axial motion of the lock knob 241 and lock body 242, moving the pin 245 toward and away from the detent body 247.

The shaft 222 extends through the inner barrel portion 206, bore 210, and collar 208 into the outer tube 140 so that the engagement portion 221 can engage an outer surface of the inner tube 160. To facilitate the adjustment of the position of the inner tube 160 and to maintain the shaft 222 in the bore 210, threads 211 are formed on the inner surface of the bore 210 and corresponding threads 235 are formed on the outer surface of the shaft 222 so that when the shaft 222 is rotated, its axial position changes as a result of the threads' interaction, thus changing the position of the inner tube 160. The shaft 222 preferably includes a reduced diameter portion 226 about which a retaining device can be mounted, such as a washer, to prevent entry of the engagement portion 221 into the bore 210 of the inner body 204.

The detent pin 246 engages the longitudinal grooves 207 of the inner body 204 such that rotation of the rotating adjustment mechanism 220 moves the pin 246 across the grooves 207. As the pin 246 moves, the bias induced by spring 249 pushes the pin 246 into the grooves 207. When the pin 246 crosses from one groove 207 to the next, the pin 246 makes an audible click as it projects into the new groove. Thus, as the user adjusts the position of the inner tube 160 by rotating the knob 247, an audible click is made by the detent pin 246 for each groove 207 it enters. Knowing how many grooves 207 there are thus enables a user to know how far the knob 247 has been turned. When a desired position has been achieved, the user turns the locking knob 241 to force the pin 245 into engagement with the detent body 247, which prevents axial motion of the detent pin 246 with less than excessive force. Since the detent pin 246 will not slide into the bore 224, rotation of the knob 247 is prevented unless extreme torque is applied, thus retaining a desired position of the inner tube 160.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A locking adjustment turret comprising:

a rotating adjustment portion mounted in a stationary portion and carrying a locking mechanism, the rotating adjustment portion including an engagement portion that is moved axially when the rotating adjustment portion is rotated, the locking mechanism substantially preventing rotation of the rotating adjustment body when engaged;

wherein the locking mechanism includes a detent pin projecting from a detent body carried in the rotating adjustment portion, a lock body on which a lock knob is mounted and from which a lock pin projects toward the detent body, the lock body being carried in the rotating adjustment portion such that rotation of the lock knob moves the lock pin axially toward and away from the detent body, rotation of the lock knob in one direction moving the lock pin into engagement with the detent body and preventing motion of the detent body, thereby retaining the rotating adjustment portion in a position;

wherein the rotating adjustment portion includes a shaft and a main body, the main body carrying the locking mechanism and the shaft carrying the engagement portion;

wherein the main body includes an axial bore in an upper portion thereof and in which the lock body is mounted and retained; and wherein the lock body includes a lock knob mount projecting from a main lock body portion, the main lock body portion also supporting the lock pin and having a diameter larger than the lock knob mount, the locking mechanism further comprising a lock body retaining device mounted in the upper portion of the rotating adjustment portion main body so that the main lock body is prevented from exiting the bore in which it is mounted.

2. The locking adjustment turret of claim 1 wherein the lock knob mount supports the lock knob so that the lock knob and the lock body rotate together.

3. The locking adjustment turret of claim 1 further comprising a stationary portion into which the rotating adjustment portion projects and in which the rotating adjustment portion is mounted, the stationary portion including an inner barrel portion bearing longitudinal grooves on an inner surface, the detent pin engaging one groove at a time.

4. The locking adjustment turret of claim 3 wherein the rotating adjustment portion includes threads that engage corresponding threads in the stationary portion to facilitate axial motion of the rotating adjustment portion when the rotating adjustment portion rotates.

5. A locking adjustment turret comprising a stationary portion, a rotating adjustment portion, and a locking mechanism in which the stationary portion includes:

an outer barrel; and an inner body; and the rotating adjustment portion includes:

a main body;

a shaft projecting from a lower end of the main body, an engagement end of the shaft being arranged to engage an object to be adjusted;

an upper portion of the main body;

an adjustment knob mounted on the upper portion of the main body for rotation therewith;

a detent mechanism in the main body configured to interact with the inner body of the stationary portion; and the main body being retained in the stationary portion such that when the adjustment knob is turned, the main body moves axially relative to the stationary portion to move the engagement end of the shaft away from and toward the stationary portion depending on a direction in which the adjustment knob is turned; and the locking mechanism includes:

a lock knob;

a lock body;

a lock knob mount on an upper end of the lock body;

a main lock body portion from which the lock knob mount projects and of larger diameter than the lock knob mount;

a lock pin projecting from a lower end of the main lock body toward the detent mechanism; and the lock body being retained in the upper portion of the rotating adjustment portion such that when the lock knob is turned, the lock body and lock pin move axially relative to the rotating adjustment portion moving the lock pin toward and away from engaging the detent mechanism depending on the direction in which the lock knob is turned.

6. The locking adjustment turret of claim 5 wherein the rotating adjustment portion main body upper portion includes an axial bore open at a top end and an outer surface of the main lock body includes threads that engage corresponding threads in the bore.

7. The locking adjustment turret of claim 5 wherein the stationary portion inner body includes a mid portion with a central bore and the shaft extends through the central bore, the bore and the shaft carrying corresponding threads interacting to retain the rotating adjustment portion and induce axial motion in the rotating adjustment portion when the adjustment knob is turned.

8. The locking adjustment turret of claim 5 wherein the stationary portion inner body includes a barrel portion through which the rotating adjustment portion extends, an inner surface of the inner body barrel portion including grooves configured to interact with the detent mechanism.

9. The locking adjustment turret of claim 8 where the detent mechanism includes a detent pin that is biased toward and engages the grooves of the barrel portion inner surface such that turning the adjustment knob moves the detent pin across the grooves, causing an audible click for each groove.

10. The locking adjustment turret of claim 5 wherein the main body portion of the rotating adjustment mechanism includes a partially diametral bore in which the detent mechanism resides, the detent mechanism including a detent pin projecting out of the bore from a detent body mounted in the bore, the detent body being biased toward an exit of the bore.

11. The locking adjustment turret of claim 10 wherein the rotating adjustment portion main body upper portion includes an axial bore extending from a top thereof to the partially diametral bore, the upper portion axial bore retaining the lock body such that the detent pin can selectively engage the detent body by adjustment of the lock knob.

12. The locking adjustment turret of claim 11 wherein the main lock body portion and inner surface of the upper portion axial bore include corresponding threads that act to retain the lock body in the axial bore and to induce axial motion of the lock body upon rotation thereof.

13. The locking adjustment turret of claim 12 wherein the lock body is prevented from exiting the upper portion axial bore by a restraining device that interferes with the lock body to prevent axial motion upward of the restraining device.

14. The locking adjustment turret of claim 13 further comprising a lock position in which the lock pin engages and restrains the detent body from axial motion.

15. A locking adjustment turret comprising a stationary portion, a rotating adjustment portion, and a locking mechanism in which the stationary portion includes:

an outer barrel comprising a plurality of equally spaced longitudinal grooves on an inner surface of an upper portion of the outer barrel; and an inner body comprising a central axial bore extending therethrough and including threads; and the rotating adjustment portion includes:

a main body including a partially diametral bore;

a shaft projecting from a lower end of the main body and carrying threads that engage and cooperate with the threads of the inner body central axial bore, an engagement end of the shaft being arranged to engage an object to be adjusted;

an upper portion of the main body including a longitudinal bore with an opening at a top of the main body upper portion and intersecting the partially diametral bore, the main body longitudinal bore including an inner surface carrying threads;

an adjustment knob mounted on the upper portion of the main body for rotation therewith;

a detent mechanism in the main body partially diametral bore and configured to interact with the inner body of the stationary portion, the detent mechanism including a detent pin projecting from a detent body mounted in the partially diametral bore, the detent pin extending toward and engaging the longitudinal grooves of the outer body inner surface, the detent mechanism further including a biasing device that urges the detent pin toward engagement with the longitudinal grooves; and the main body being retained in the stationary portion by the cooperation of the threads on the main body and the threads in the axial bore such that when the adjustment knob is turned, the main body moves axially relative to the stationary portion to move the engagement end of the shaft away from and toward the stationary portion depending on a direction in which the adjustment knob is turned; and the locking mechanism includes:

a lock knob;

a lock body;

a lock knob mount on an upper end of the lock body;

a main lock body portion from which the lock knob mount projects and of larger diameter than the lock knob mount, the main lock body portion including threads on an outer surface thereof that cooperate with the threads of the main body upper portion longitudinal bore;

a lock pin projecting from a lower end of the main lock body toward detent body; and the lock body being retained in the upper portion of the rotating adjustment portion by cooperation of the threads on the main lock body portion and the upper portion longitudinal bore such that when the lock knob is turned, the lock body and lock pin move axially relative to the rotating adjustment portion moving the lock pin toward and away from engaging the detent mechanism depending on the direction in which the lock knob is turned, the locking adjustment turret further comprising a lock position in which the lock pin engages and restrains the detent body from axial motion.

* * * * *